United States Patent [19]

Schulze et al.

[11] 4,398,657

[45] Aug. 16, 1983

[54] FEEDING DEVICE, IN PARTICULAR FOR THE CYCLED FEEDING OF ROD OR TAPE LIKE MATERIAL IN PRESSES, CUTTERS, OR THE LIKE

[75] Inventors: Eckehart Schulze, Weissach-Flacht; Werner Kuttruf, Wuppertal, both of Fed. Rep. of Germany

[73] Assignee: Hartmann & Lämmle GmbH & Co. KG, Rutesheim, Fed. Rep. of Germany

[21] Appl. No.: 236,713

[22] Filed: Feb. 23, 1981

[30] Foreign Application Priority Data

Feb. 28, 1980 [DE] Fed. Rep. of Germany ..... 3007492

[51] Int. Cl.[3] ..... B65H 17/20; B65H 23/22; B65H 25/20

[52] U.S. Cl. ..... 226/11; 226/42; 226/178

[58] Field of Search ..... 226/178, 111, 181, 42, 226/30, 10, 11, 24, 29; 74/499; 137/636; 91/35, 380

[56] References Cited

U.S. PATENT DOCUMENTS

| | | | |
|---|---|---|---|
| 2,924,328 | 2/1960 | Lidderdale | 226/178 X |
| 3,026,011 | 3/1962 | Grass | 226/178 |
| 3,556,368 | 1/1971 | Rene | 226/11 |
| 3,771,703 | 11/1973 | Denis | 226/42 |
| 3,797,364 | 3/1974 | Schulze | 91/380 |
| 3,997,093 | 12/1976 | Aizawa et al. | 226/11 |
| 4,078,416 | 3/1978 | Voorhees | 226/178 |
| 4,119,255 | 10/1978 | D'Angelo | 226/11 X |

FOREIGN PATENT DOCUMENTS

| | | | |
|---|---|---|---|
| 554425 | 6/1923 | France | 226/11 |

*Primary Examiner*—Stuart S. Levy
*Assistant Examiner*—Daniel P. Stodola
*Attorney, Agent, or Firm*—Michael J. Striker

[57] ABSTRACT

Feeding device for the cycled feeding of rod or tape-like material into a press, cutter or the like, which includes a metering wheel which rolls off directly or indirectly on the material being fed, serving as a true value indicator. The metering wheel is coupled with a true value input metering spindle which acts upon a hydraulic control valve device. The exactly maintained feeding path is made possible by the mechanical coupling of the true value feeding with the true value input on the control hydraulic valve device.

16 Claims, 4 Drawing Figures

FEEDING DEVICE, IN PARTICULAR FOR THE CYCLED FEEDING OF ROD OR TAPE LIKE MATERIAL IN PRESSES, CUTTERS, OR THE LIKE

BACKGROUND OF THE INVENTION

The invention relates to a feeding device, in particular for the cycled feeding of rod or tape like material in presses, cutters or the like, wherein at least one feeding roller or wheel, respectively, is driveable by means of a controllable hydromotor, and that the feeding path is advanced by a setting means and is controllable by a true value indicator which acts on a hydraulic control valve.

It is known to control the hydromotor by a servo valve which is controlled by a magnifier in such a feeding device, wherein the drive speed of the hydromotor is measured by means of a tacho-alternator and the real displacement path is measured by an incremental path measuring system and is electrically controlled by means of a nominal value comparison, while the magnifier control the servo valve. The nominal value feeding may be achieved through a direct current motor or a stepping motor. The control circuit amplification which is obtained with such an arrangement is fed through the incremental indicator and the electric control logic is relatively small, that is, one can operate exactly with such an arrangement, but due to the small control circuit amplification only correspondingly low stroke number are achievable.

In highly dynamic rapid drives, the feeding rollers must be strongly engaged so that the slippage between material and feeding rollers is kept low. However, connected therewith is the disadvantage that with different material hardness or with coated materials, for example, with a plastic coating a rolling out effect occurs within one feeding. This rolling out effect results in longitudinal errors in addition to slippage. In order to take such errors into consideration it is known not to determine the true value position from the position of a feeding roller, but by a metering wheel which runs on the rod or tape like material in accordance with one or a plurality of feeding rollers.

Electro-hydraulical rotary magnifier drives are now known with which a high dynamic rapid drive is made possible. With high dynamic stepping motors in the nominal value feeding such a high control circuit magnification can be obtained and is at this time the fastest drive for the aforementioned applications (U.S. Pat. No. 3,797,364).

The advantage of the high control circuit amplification is getting lost when using a metering wheel in conjunction with an incremental measuring system by converting mechanical measuring dimensions into electrical dimensions and reconverting during the control into a mechanical dimension for controlling the servo valve.

SUMMARY OF THE INVENTION

It is an object of the invention to provide a feeding device of the aforementioned type which enables a high dynamic and rapid, in particular cycled feeding taking into consideration slippage and roll out effects, so that, in particular stamps, presses, cutters, or the like may be operable with high stroke numbers and the required high feeding speeds of the material with great exactness.

To solve this object of the invention provides that a metering wheel is provided which rolls off directly or indirectly on the rod or tape-like material serving as a true value indicator, and that this metering wheel is mechanically coupled with the true value input spindle which acts on the control valve. The exactly maintained feeding path is made possible by the mechanical coupling of the true value feeding to the true value input on the control valve without electrical or electronic intermediary transmissions.

Particular advantageously, the mechanical coupling between the metering wheel and the true value input on the control valve can be interruptable by a coupling, so as to enable an operation without true value return feeding. Furthermore, advantageously the true value indicator which acts on the control valve can be separably coupled by a coupling with the output of the hydrometer motor, so as to prevent a continuous drive when material is missing or material build up, or similar, by switching the coupling. Advantageously, the coupling can be switchable by an end switch which is controlled by the rod or tape-like material, whereby during missing of the material the true value input of the control valve is coupled with the output of the hydromotor. Thus, an undesirable further feeding, in particular of tape like material due to bending and not reaching the metering wheel can be safely prevented.

A particular high cycled operating speed is obtainable in that a rotary magnifier serves as the drive for the feeding roller and that the same is provided with a stepping motor with respect to the nominal value input, whereby the control valve is controllable through a metering spindle which is displaceable in the axial direction and/or controllable with respect to the metering spindle by a nut part and a thread, and that control conduits are changeable in their cross section and in their connection for pressure admittance of the hydromotor, due to the axial displacement of the metering spindle and/or nut part.

For reducing the friction and thereby to enable a substantial increase of the control circuit amplification a ball rotary thread can serve as a thread with balls which are guided in helical like grooves, whereby it is particularly advantageous that the balls of the ball rotary thread are guided individually and at a distance from each other in a cage.

For a further clearance balance the metering spindle and the nut part are tensioned against each other in the axial direction by a spring. Simultaneously, the spring can cause a rotating moment on the metering wheel, whereby in furtherance due to this rotating moment a pulling force is applied by the metering wheel on the rod or tape like material. This opens the possibility to process materials, made of flexible material like paper, cloth or foil webs without any additional feeding means in stamps, presses, cutters, or the like, by preventing a fold formation or a build up and by a simultaneous substantially higher processing speed. It is essential that the metering wheel of the feeding roller is switched in series in front of or even better at the rear of the stamp or press, if this is possible in that tape-like remainder portions are not completely stamped out from the tape like material. The processing and possibilities of use of such inventive feeding devices, in particular for the cycled feeding are substantially expanded and, in particular the cycle speed and thereby the economy of the total device can be substantially increased, at least by the factor of 10 with respect to the hitherto known devices.

The feeding tolerances at high feeding and cycle speed may be held particularly small in that valves with valve seat cones and valve cones of the control valve are actuable by the metering spindle or the nut part by means of one each specially guided actuating pin.

In a particular embodiment the nut part is guided axially displaceable and rotatable by a ball guide and is rotatable with respect to the metering spindle by the stepping motor which is controlled by the setting means.

Particularly advantageous is that the metering spindle or the nut part are mechanically coupled with the metering wheel and are rotatable by the metering wheel. Furthermore, the nut part or the metering spindle are also rotatable by the stepping motor. The control of the control valve is carried out directly with the least friction by the differential movement. Even at a thread pitch of the ball thread between the metering spindle and the nut part of 2 mm a sufficient rotating moment transmission from the stepping motor to the metering wheel occurs at the lowest friction, so that by this rotating moment a sufficient pulling force from the metering wheel onto the rod or tape like material is assured for holding the tape like material in a tensioned position for a safe throughput through, for example, the tool of a press. Preferably a tension roller may be provided on the metering roller or may coact with the metering roller for a rotating field super-imposition, so as to eliminate a fold formation at the beginning of the feeding movement at very high operating speeds.

In order to have low transmission losses the metering may be coupled with the metering spindle by at least a shaft, a gear belt and the coupling, whereby the transmissions can be so chosen that the circumferential speed of the feeding roller and the metering roller correspond to each other, if need be, by taking into consideration a rolling out or an extending effect and an eventual slippage. However, this is not required. A wear of the feeding roller can be compensated by the control technology, so that a wear of the transport roller is without influence on the control exactness, so that the feeding roller does not have to be replaced at a high expense, after running for a certain time. The exact circumferential length of the metering roller is important for the exact control and if worn this metering wheel must be replaced, if need be, or the wear must be taken into consideration by the control technology.

It can be advantageous for the safety of the device that by an axial displacement of the metering spindle and/or nut part the drive or the nominal value advance is controllable in its speed in dependence from the axial displacement and/or arrestable when reaching an advanced extreme position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
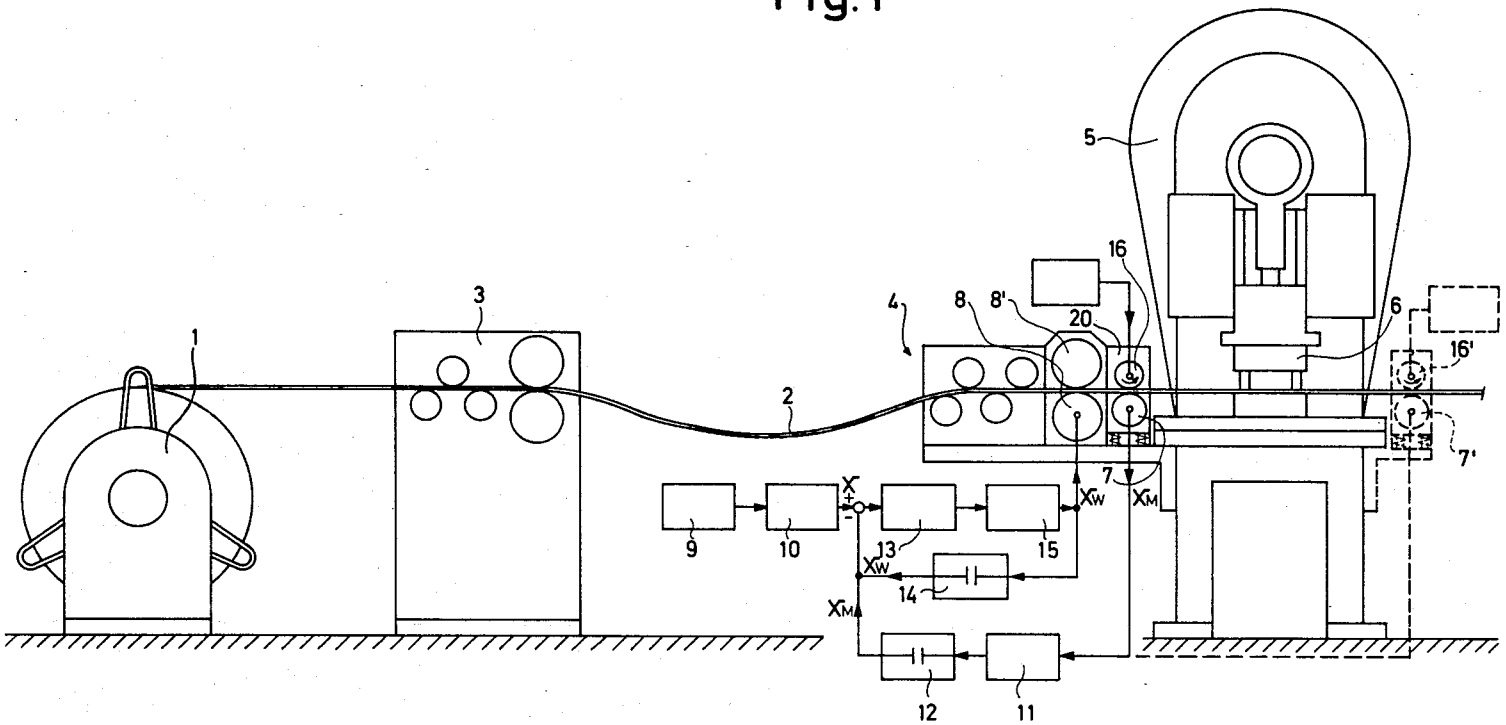
FIG. 1 a schematic view of a stamp with a feeding device for tape like material with a metering wheel in front of the stamp and in a dotted line, a view of an alternative arrangement of the metering wheel at the rear of the stamp with a schematic control circuit FIG. 2 a schematic view of a rotary amplifier for the feeding roller drive with the metering wheel FIG. 3 a partial view through the rotational drive at an enlarged scale, as shown in FIG. 2.

In accordance with FIG. 1, a tape like material 2 is removable from a capstan 1 through an aligning machine 3 by means of a feeding device 4 and is feedable to a press 5 in which a die tool 6 is provided for processing the tape like material 2, for example. The remainder of the material which is not stamped out is moved through the die tool 6 and removed. As shown in FIG. 1 a metering wheel 7 may be disposed between the die tool 6 and the feeding device 4 through which the true value position $X_M$ is determined. As shown in dotted lines, the metering wheel 7 may be disposed at the press output as metering wheel 7'.

During the time of the upper rotation in press 5 the tape like material 2 must be cycled and must be fed by a desired cycle. Therefore, the feeding device 4 must be running in a cycle and stepwise. At a high rotational speed of press 5 high feeding speeds are required, so that the two feeding rollers 8,8' of feeding device 4 must be pressed together with a corresponding force. This can result in a rolling out effect, so that the variable circumferential path of the feeding roller 8 does not correspond to the required feeding path of material 2. The true feeding path is determined by the metering wheel 7 or 7' and the roller feeding is correspondingly controlled, whereby the control is carried out in accordance with the sketch of FIG. 1. The nominal value X nominal is advanced by a stepping motor 9 and a drive 10, while the value $X_M$ is fed to a control 13 by the metering wheel 7 or 7', a measuring drive 11 and a coupling 12. To this control, the roller position $X_W$ true value may be fed through a switchable coupling 14, instead of the value $X_M$ true value. X nominal value and $X_M$ true value are approximated to each other by the control and a power magnifier in form of a hydromotor 15.

An adjustment roller 16 or 16' is mounted opposite of metering wheel 7 or 7' for eliminating slippage, whereby this adjustment roller may be driven by a rotary field or a pull drive for achieving a tension force on material 2.

Figure 2:
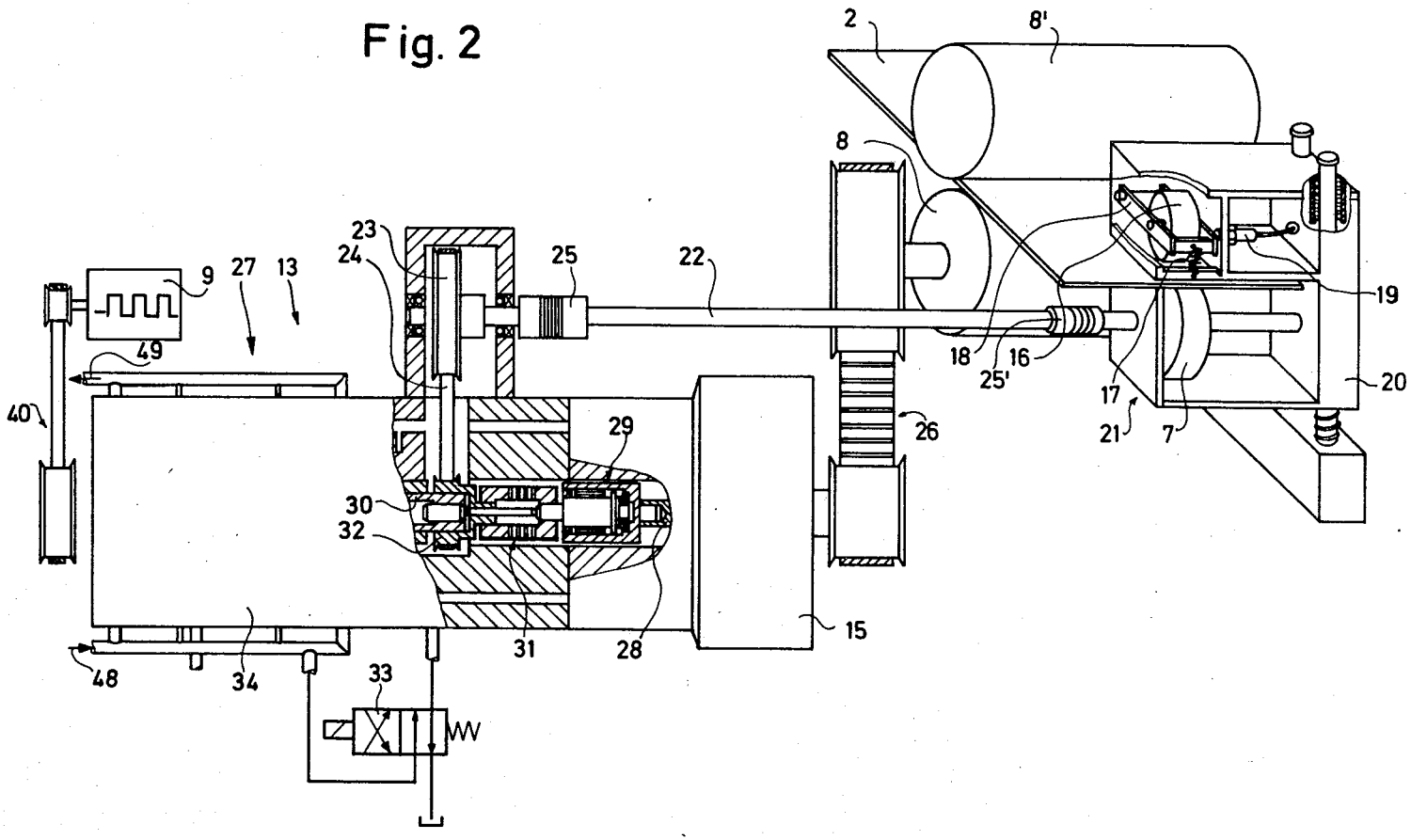

FIG. 2 shows in an enlarged scale further details of the arrangement, whereby in all FIGS. the same numeral references are used for the same parts. From there it can be seen that the adjustment roller 16 is pulled by a spring 17 against the metering wheel 7 by stressing the material 2, whereby the adjustment roller is correspondingly mounted in a frame 18. An end switch 19 is actuable by this frame which reacts when no material 2 is present between the metering wheel 7 and adjustment roller 16. These parts are adjustably mounted in a frame 20 of press 5. The metering wheel 7 serves as a true value indicator 21 and is therefore mechanically coupled with control 13 by means of a shaft 22, a gear wheel 23 and a gear belt 24. Shaft 22 is provided with two joints 25,25' for balancing any eventually occuring alignment errors.

In the embodiment, the lower feeding roller 8 is coupled with the hydromotor 15 by means of a gear belt drive 26. The hydromotor 15 is controlled by a control valve 27 contained in control 13 and is shown in more detail in FIGS. 3 and 4, whereby an inner output shaft 28 of hydromotor 15 is separable or connectable with a metering spindle 30 by a switchable coupling 29. Simultaneously, the metering spindle 30 is also connectable with a gear belt wheel 32 by a switchable coupling 31 in conjunction with switchable coupling 29, whereby the gear belt wheel 32 is driveable by the metering wheel 7 through gear belt 24. In the normal operation the metering wheel 7 is coupled with metering spindle by coupling 31, while the switch coupling 29 separates the metering spindle 30 and the inner output shaft 28 of the hydromotor. When the end switch 19 reacts, when no rod or tape-like material 2 is mounted on metering wheel 7, the mechanical connection between the metering wheel 7 and the metering spindle 30 is interrupted by a switch valve 33 and a mechanical connection is generated between the metering spindle 30 and the output shaft 28 of hydromotor 15. Thus, an uncontrollable running or stopping of metering wheel 7 is prevented through which wrong true values would be advanced. The control is then further executed with the approximating "true values" of hydromotor 15, so as to maintain the feeding device 4 operational for a further feeding of a new reel with material 2. The required measures to be taken may be initiated with the end switch 19.

Figure 3:
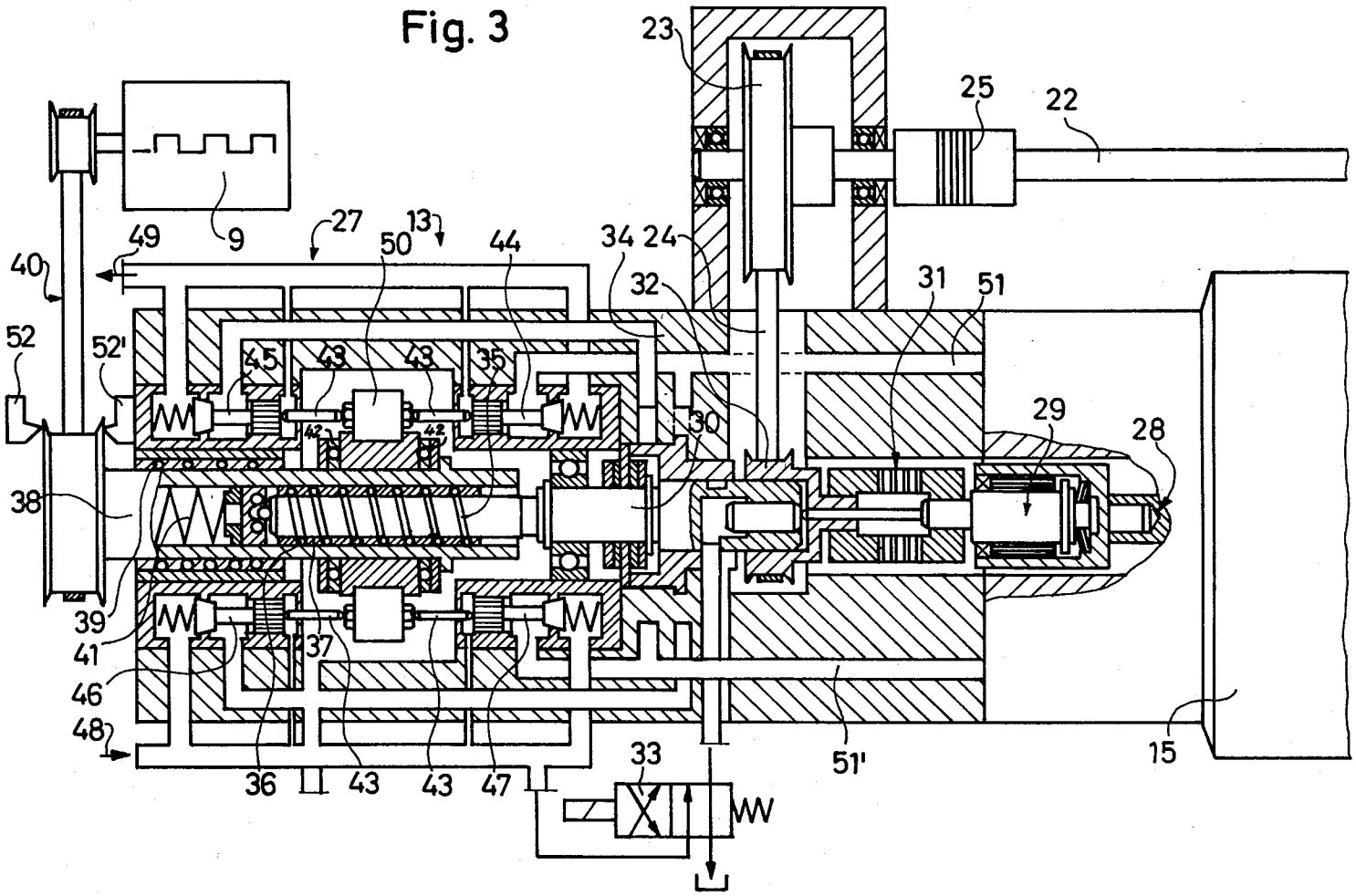

In the embodiment of a control shown in FIG. 3, the metering spindle 30 is rotatable but axially displaceably mounted by a certain amount in control housing 34. On the one hand, the metering spindle 30 supports helically shaped thread grooves 35 for balls 36 of a ball rotary thread 37 which is disposed between the metering spindle 30 and a nut part 38. This nut part is guided in control housing 34 rotatably and axially displaceable by a ball rotary guide 39 and is driveable through a gear belt drive 40 and stepping motor 9. The metering spindle 30 and the nut part 38 are tensioned with each other in axial direction by a tension spring 41, whereby a rotating moment is generated through the ball rotary thread 37 between the stepping motor 9 and the metering wheel 7, through which a tension force is transmitted in feeding direction of the band-like material 2.

A switch member 50 is mounted on the nut part 38 above ball bearing 42 through which pairs of opposite valves 44 to 47 are actuable by means of specially displaceable mounted actuating pins 43. These are pressure balanced seal valves.

Thereby, at valves 46 and 47 the outer positioned front faces of the valve cone and the pressure balance element are connected with a pressure oil flow 48 and accordingly the outer positioned front faces of the valve cones and the pressure balance element of valves 44 and 45 are connected with a tank return flow 49, while the inner valve chambers of valves 44 and 46 are connected with a chamber, not shown in detail, of hydromotor 15 and the inner chambers of the other valves 45 and 47 are connected with the other chamber of hydromotor 15. Pressure oil is supplied to the hydromotor 15 by an axial displacement of the switch member 50 to the left through valve 46 and line 51, while pressure oil may flow out of the hydromotor 15 through line 51' and valve 45. Due to the rotary movement of the hydromotor the metering spindle 30 is so turned that the nut part 38 is displaced to the right and thereby closing valves 45 and 46 through switch member 50 and when exceedingly rotating the valves 44 and 47 are opened, so as to initiate a return movement. Due to this control the hydromotor 15 follows the rotating movement advanced by the stepping motor 9. In order to prevent damages during a pressure loss or an over-loading, approximate or end switches 52,52' may be provided on the nut part 38, for example, through which the stepping motor 9 or the oil pressure supply is influenced or may be arrested when reaching extreme values.

Figure 4:
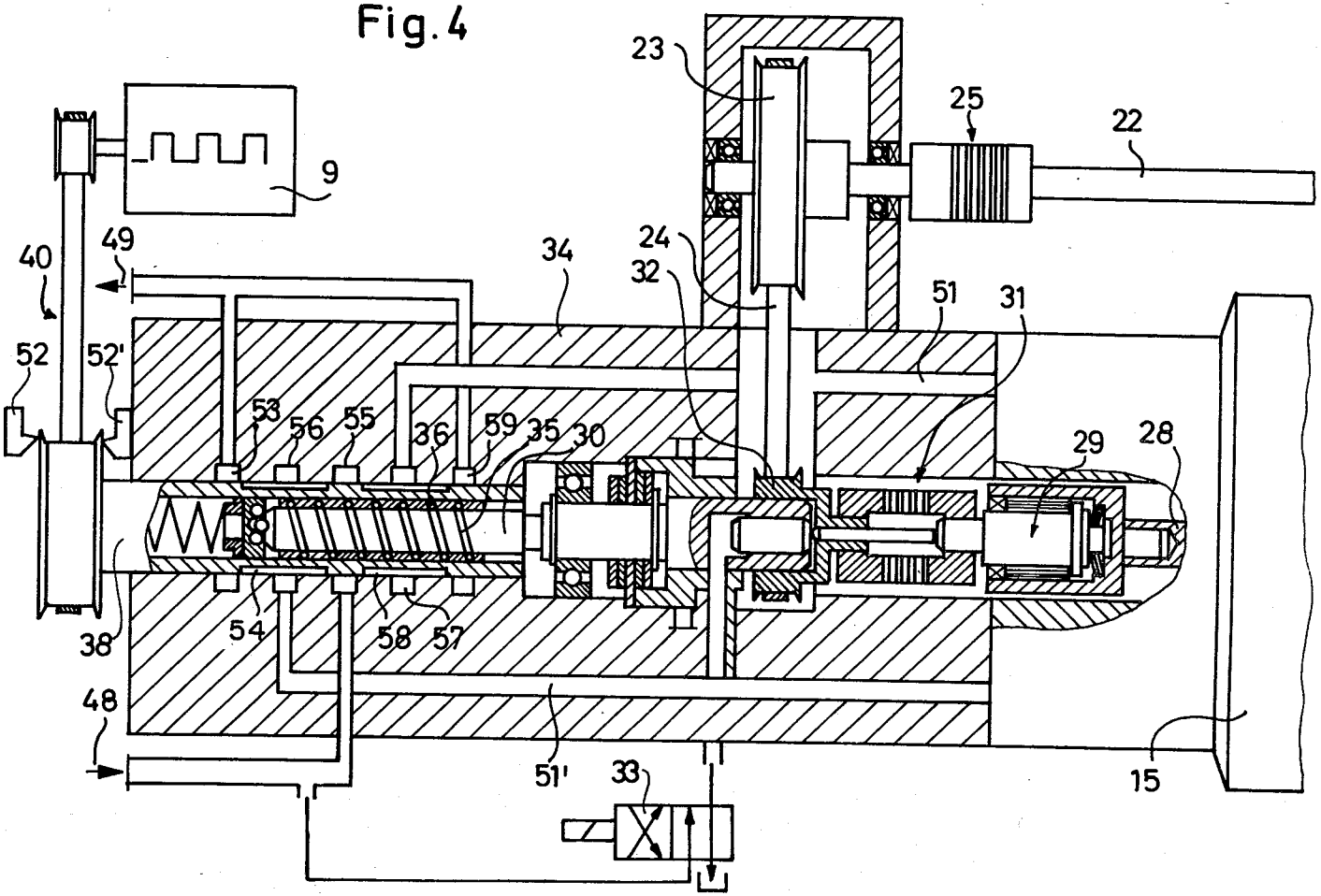
FIG. 4 a further embodiment of a rotary amplifier.

In the embodiment of FIG. 4 a slide control is provided instead of the four valves 44 to 47, whereby the outer positioned annular conduits 53 and 59 in control housing 34 are connected with the tank return flow 49, the center annular conduit 55 with the pressure oil supply flow 48 and the annular conduits 56 and 57 are connected through lines 51' or 51 with the pressure chambers of hydromotor 15. Two apertures 54 and 58 are provided in the nut part 38 through which the conduits 53 and 56, and 55 and 57 or the conduits 56 and 55, and 59 and 57 are connected with each other depending on the position of nut part 38, whereby in the same manner as in the embodiment of FIG. 3 during a turning of nut part 38 by stepping motor 9 through the corresponding pressure oil admittance of hydromotor 15 the rotational movement of the hydromotor follows until through metering wheel 7, after an executed feeding of material 2 by feeding rollers 8,8' a nominal value position of the nut part 38 and a corresponding true value position of the metering spindle 30 exists, advanced by stepping motor 9.

We claim:

1. Feeding device for the cycled feeding of rod or tape-line material into a press, cutter or the like, comprising at least one feeding roller mounted in contact with the material to be fed; a stepping motor for advancing said roller in a feeding path; a controllable hydromotor interconnected between said stepping motor and said feeding roller; a true value indicator including a metering wheel which rolls off at least indirectly on the material being fed; hydraulic control valve means; a true value input metering spindle releasably-connectable to said hydromotor, said true value input metering spindle being mechanically coupled to said metering wheel, said hydraulic control valve means being adapted to control said hydromotor so as to connect or disconnect said metering spindle from said hydromotor; a first coupling adapted to interrupt the mechanical coupling between said true value input metering spindle and said metering wheel; a second coupling, said hydromotor having an output, said second coupling being mounted to said output and operated for selectively connecting to or disconnecting said metering spindle from said hydromotor; an end switch which is controlled by the material being fed, said end switch being adapted to switch on and off said first and said second couplings so that when the material to be fed is missing on said feeding roller said metering spindle is coupled to the output of said hydromotor; and rotary magnifier means operatively interconnected between said stepping motor and said metering spindle, said rotary magnifier means including a nut part connected to said stepping motor which drive the latter, and a ball rotary thread means disposed between the metering spindle and said nut part and operative so that said metering spindle is displaceable in the axial direction thereof to control said control valve means which are provided with a plurality of control conduits connectable to said hydromotor.

2. Feeding device as defined in claim 1, said control conduits being changeable in their cross-sections and in their connections to said hydromotor in response to the axial displacement of said metering spindle.

3. Feeding device as defined in claim 2, said ball rotary thread means including a plurality of balls, said metering spindle being formed with a plurality of helically-shaped grooves, said balls being guided in said grooves.

4. Feeding device as defined in claim 3, wherein said balls are guided individually and at a distance from each other.

5. Feeding device as defined in claim 4, further including a ball guide surrounding said nut part, said nut part being rotatable in said ball guide with respect to said metering spindle by said stepping motor, said nut part being displaceable in said axial direction.

6. Feeding device as defined in claim 3, wherein said metering spindle and said nut part are tensioned against each other by a spring, said spring causing a rotating moment on the metering wheel, due to this rotating moment a pulling force being applied by the metering wheel onto the material being fed in a feeding direction.

7. Feeding device as defined in claim 6, wherein said control valve means include a number of valves having seats and valve cones and connected to said hydromotor.

8. Feeding device as defined in claim 7, wherein said valves are actuated by said metering spindle.

9. Feeding device as defined in claim 7, including switch means and guided actuating pins connected thereto, said switch means and actuating pins being mounted to said nut part and operative for actuating said valves.

10. Feeding device as defined in claim 9, wherein said control valve means include four said valves, said valves being balanced and disposed flush in pairs facing the associated actuating pins.

11. Feeding device as defined in claim 10, wherein a clearance between the switch means and the valve seat of each valve is provided, said clearance being adjustable.

12. Feeding device as defined in claim 1, further including an adjustment roller, the material being fed between said metering wheel and said adjustment roller.

13. Feeding device as defined in claim 12, said end switch being connected to said adjustment roller.

14. Feeding device as defined in claim 13, further including hydraulic switch means, said end switch activating said hydraulic switch means to hydraulically actuate said first and second couplings.

15. Feeding device as defined in claim 14, wherein said metering wheel is coupled with said metering spindle by at least one shaft, a gear belt connected to said shaft, and said first coupling.

16. Feeding device as defined in claim 15, wherein the transmission of the metering wheel to the metering spindle is adjustable at least within certain limits to compensate for possible wear.

* * * * *